US007096634B2

(12) United States Patent
Dean, Jr.

(10) Patent No.: US 7,096,634 B2
(45) Date of Patent: Aug. 29, 2006

(54) BLOCK WALL SYSTEM

(75) Inventor: Robert W. Dean, Jr., Milwaukee, WI (US)

(73) Assignee: Innovative Concrete Design, Inc., Milwaukee, WI (US)

( * ) Notice: Subject to any disclaimer, the term of this patent is extended or adjusted under 35 U.S.C. 154(b) by 307 days.

(21) Appl. No.: 10/693,062

(22) Filed: Oct. 24, 2003

(65) Prior Publication Data

US 2005/0086892 A1 Apr. 28, 2005

(51) Int. Cl.
*E04C 3/30* (2006.01)

(52) U.S. Cl. ..... 52/574

(58) Field of Classification Search ..... 52/608, 52/609, 574, 575, 586.2, 592.6, 505, 607; 405/262

See application file for complete search history.

(56) References Cited

U.S. PATENT DOCUMENTS

| | | | | | |
|---|---|---|---|---|---|
| 880,154 | A | * | 2/1908 | Mueller | 52/586.2 |
| 2,392,551 | A | * | 1/1946 | Roe | 52/586.2 |
| 4,312,606 | A | | 1/1982 | Sarikelle | |
| 4,335,549 | A | | 6/1982 | Dean, Jr. | |
| 4,524,551 | A | | 6/1985 | Scheiwiller | |
| 4,731,279 | A | * | 3/1988 | Isshiki | 428/159 |
| 4,738,059 | A | | 4/1988 | Dean, Jr. | |
| 4,914,876 | A | | 4/1990 | Forsberg | |
| 4,920,712 | A | | 5/1990 | Dean, Jr. | |
| 4,926,595 | A | | 5/1990 | Dean, Jr. | |
| RE34,314 | E | | 7/1993 | Forsberg | |
| 5,282,700 | A | | 2/1994 | Rodrique | |
| 5,564,240 | A | | 10/1996 | Dean, Jr. | |
| 5,642,968 | A | * | 7/1997 | Anderson et al. | 405/286 |
| 5,851,088 | A | | 12/1998 | Anderson et al. | |
| 5,865,006 | A | | 2/1999 | Dawson | |
| 6,035,599 | A | * | 3/2000 | Sonnentag | 52/604 |
| 6,070,379 | A | | 6/2000 | Dean, Jr. | |
| 6,149,352 | A | | 11/2000 | MacDonald | |
| D438,988 | S | | 3/2001 | Dean, Jr. | |
| 6,447,213 | B1 | | 9/2002 | MacDonald | |
| 6,464,432 | B1 | | 10/2002 | Shaw | |
| 6,616,382 | B1 | | 9/2003 | Woolford et al. | |
| 6,637,981 | B1 | | 10/2003 | MacDonald | |
| 6,912,823 | B1 | * | 7/2005 | MacDonald et al. | 52/574 |
| 2002/0028114 | A1 | * | 3/2002 | Whitson | 405/284 |
| 2005/0108973 | A1 | * | 5/2005 | Hammer et al. | 52/596 |

* cited by examiner

*Primary Examiner*—Naoko Slack
*Assistant Examiner*—Jessica Laux
(74) *Attorney, Agent, or Firm*—Quarles & Brady LLP

(57) ABSTRACT

A block suitable for forming a block wall that is either a retaining wall or an above ground wall. The block includes a front wall extending between upper and lower block surfaces and presenting a first block face. A rear wall is spaced from said front wall and extends between the upper and lower block surfaces and presents a second block face facing away from the first block face. A pair of side walls extend between the front and rear walls and the upper and lower block surfaces, wherein a reference plane spaced from the front and rear walls extend between the pair of side walls. At least one pair of pin slots is formed in the upper block surface, wherein each pin slot of the at least one pair of pin slots is formed in the upper block surface on opposing sides of the reference plane and spaced from the reference plane. An opening is formed in the lower block surface, has a forward facing inner wall intersecting the lower block surface and spaced rearwardly from the reference line and a rearward facing inner wall intersecting the lower block surface and spaced forwardly from the reference plane, wherein the inner walls at the lower block surface are closer to the reference plane than the pin slots.

36 Claims, 6 Drawing Sheets

FIG. 7
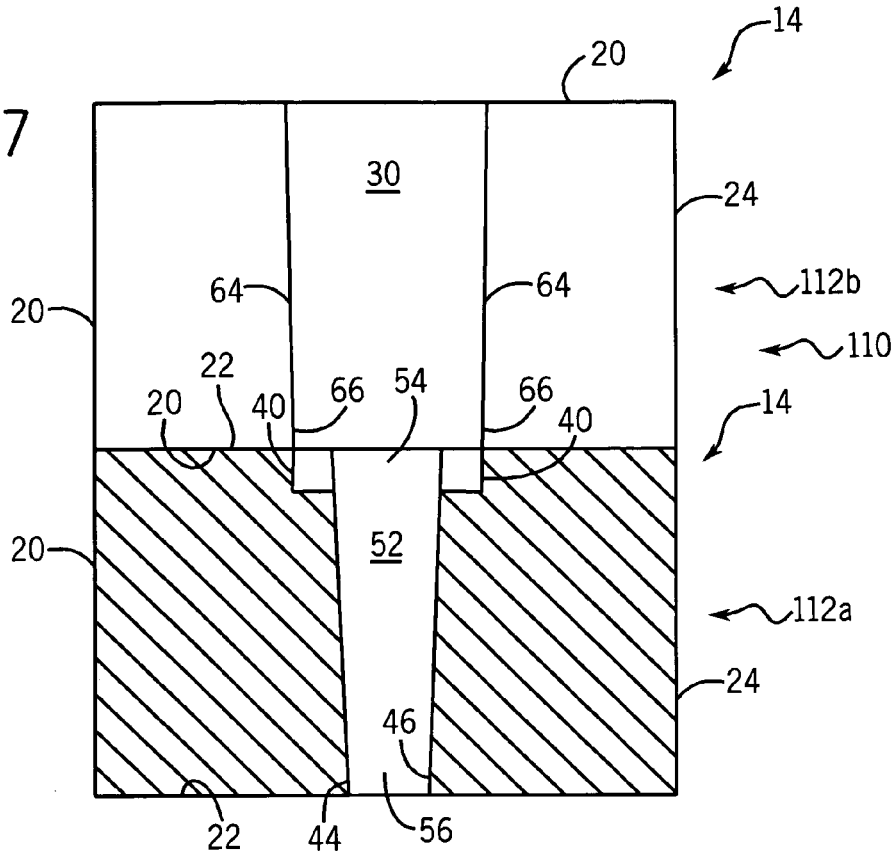
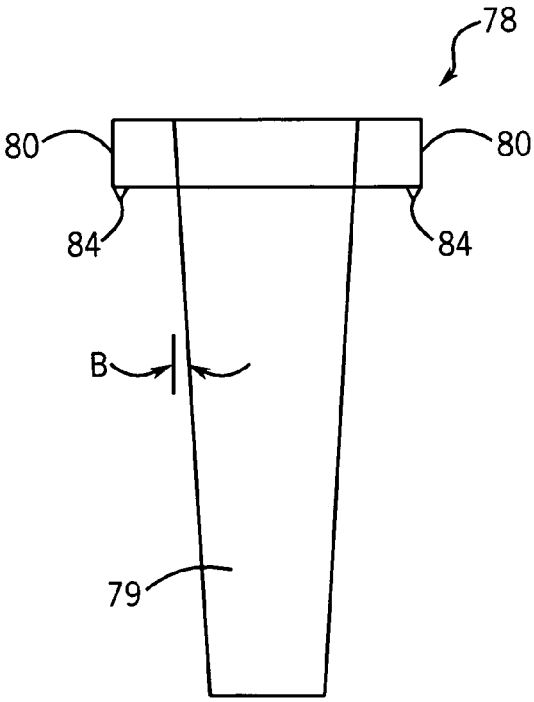
FIG. 9
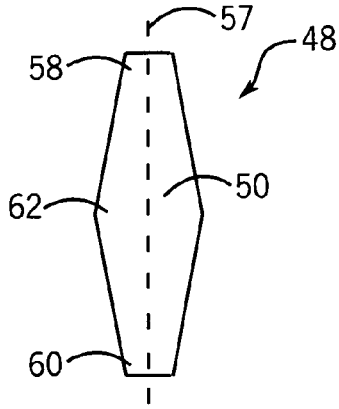
FIG. 10

BLOCK WALL SYSTEM

CROSS REFERENCES TO RELATED APPLICATIONS

Not Applicable.

STATEMENT REGARDING FEDERALLY SPONSORED RESEARCH

Not Applicable

BACKGROUND OF THE INVENTION

This invention relates to block walls, and more particularly to block wall systems for building retaining and above ground block walls.

Block wall systems are typically formed from manufactured blocks that interlock to form a retaining wall or decorative above ground wall. The blocks are typically formed for use in either a retaining wall or a decorative above ground wall, but not both because of the differences between the walls. In particular, a retaining wall typically must be built with a batter angle (i.e. the face of the wall defines an angle) in order to retain soil behind the wall. Moreover, because only a front face of each block forming the wall is exposed, only the exposed face is typically provided with a texture or pattern. On the other hand, an above ground wall does not have a batter angle, and front and rear faces of each block are exposed requiring a pattern or texture.

Alignment mechanisms for aligning the blocks in either a retaining wall or above ground wall are known in the art. However, these mechanisms are not useful for both retaining and above ground walls because of the above differences in the wall. In particular, alignment mechanisms for use in retaining walls do not provide for turning a block around to expose a face different from the face intended to be exposed. Moreover, alignment mechanisms for use in above ground decorative walls do not provide for forming a block wall with a batter angle. Therefore, a need exists for a block including an alignment mechanism that can be used to build both a retaining wall and an above ground wall.

Both retaining walls and above ground walls are built in straight or curved sections. Blocks having side walls substantially perpendicular to the front and rear walls of the block are often used to build both straight and curved walls. Unfortunately, these blocks leave gaps between blocks when building curved block walls, which can weaken the block wall. Blocks having non-perpendicular side walls relative to the front and rear walls of the block are often used to build curved walls. Unfortunately, these curved wall blocks leave gaps when building a straight wall. Accordingly, a need exists for blocks that can be used to build both a straight block wall and a curved block wall without forming gaps that can weaken the block wall.

SUMMARY OF THE INVENTION

The present invention provides a block suitable for forming a block wall that is either a retaining wall or an above ground wall. The block includes a front wall extending between upper and lower block surfaces and presenting a first block face. A rear wall is spaced from said front wall and extends between the upper and lower block surfaces and presents a second block face facing away from the first block face. A pair of side walls extend between the front and rear walls and the upper and lower block surfaces, wherein a reference plane spaced from the front and rear walls extends between the pair of side walls. At least one pair of pin slots is formed in the upper block surface, wherein each pin slot of the at least one pair of pin slots is formed in the upper block surface on opposing sides of the reference plane and spaced from the reference plane. An opening is formed in the lower block surface, and has a forward facing inner wall intersecting the lower block surface and spaced rearwardly from the reference line and a rearward facing inner wall intersecting the lower block surface and spaced forwardly from the reference plane. The inner walls at the lower block surface are closer to the reference plane than the pin slots.

A general objective of the present invention is to provide a block that can be used to build either a retaining wall or an above ground wall. This objective is accomplished by providing the block with first and second block faces and pairs of pin slots and inner walls, such that the block can have either or both block faces exposed and either block face can be exposed in a retaining wall while maintaining the desired batter angle.

Another objective of the present invention is to provide a block that can be used to build straight and curved walls without gaps between the blocks. This objective is accomplished in an embodiment of the invention in which at least one of the side walls of the block defines an obtuse angle with one of the front and rear walls of the block which allows the angled side wall to abut either a non complementary angled side wall to form a curved wall or complementary angled side wall to form a straight wall.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 7 is a sectional view along line 7—7 of FIG. 6;

FIG. 9 is an elevational side view of the mold insert of FIG. 8;

FIG. 10 is an elevational view of a pin which can be used in the block wall of FIG. 1;

DETAILED DESCRIPTION OF THE INVENTION

Figure 1:
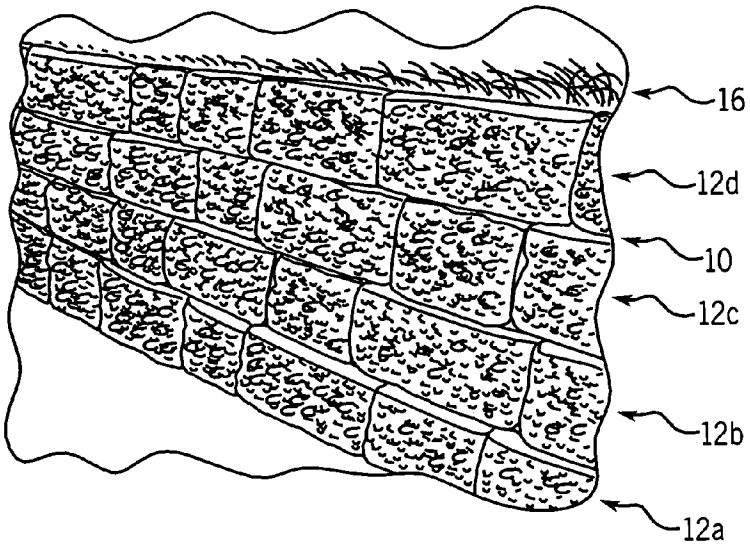
FIG. 1 is a perspective view of a straight retaining block wall incorporating the present invention.

As shown in FIGS. 1–4, a retaining block wall 10 formed from a plurality of rows, or courses 12*a*, 12*b*, 12*c*, 12*d* of blocks 14*a*, 14*b*, 14*c*, 14*d* is set into a hill to retain the earth 16 forming the hill. The block wall 10 includes a base course 12*a* set on a leveled portion of ground or a concrete footing. The second course 12*b* is set on the base course 12*a*, and the exposed face 18*b* of the second course 12*b* is set back a distance away from the exposed face 18*a* of the base course 12*a* to provide a batter angle. Each successive course 12*c*, 12*d* is set on the next lower course to build the wall up to the desired height. Cap blocks (not shown) can be set on the top course 12*d* of blocks to finish of the wall top.

The blocks 14*a*, 14*b*, 14*c*, 14*d* include substantially the same elements, and will therefore be referred to as block 14 unless the description requires reference to a specific block. Each block 14 in the block wall 10 has an upper block surface 20 which can support the next (upper) course of blocks and a lower block surface 22 which can rest on a previous (lower) course of blocks, or the leveled portion of ground or concrete footing. The upper and lower block surfaces 20, 22 are joined by a front wall 24, rear wall 26, and a pair of side walls 28, 30. Preferably, the blocks 14 are molded concrete using a method such as described below. However, the blocks 14 can be formed from any suitable construction material, such as metal, wood, ceramic, brick, and the like, without departing from the scope of the invention. Moreover, although only four distinct blocks 143*a*, 14*b*, 14*c*, 14*d* are shown for building the block wall 10, one or more blocks, such as described herein, can be used to build a block wall without departing from the scope of the invention.

The front wall 24 of the block 14 extends between the upper and lower block surfaces 20, 22 and presents a rugged first block face, such as formed by molding, splitting material from the block, and the like. Although a front wall 24 having a rugged block face is preferred, the block face of the front wall 24 can be smooth, patterned, and the like, without departing from the scope of the invention. Moreover, although a substantially planar front wall 24 is disclosed, the front wall 24 can have a multi-faceted face without departing from the scope of the invention.

The rear wall 26 is spaced from the front wall 24, and extends between the upper and lower block surfaces 20, 22. The rear wall 26 presents a second block face facing away from the first block face presented by the front wall 24. The second block face is preferably a rugged block face formed using a method described above. Although a rear wall 26 having a rugged block face is preferred, the block face of the rear wall 26 can be smooth, patterned, and the like without departing from the scope of the invention. Moreover, although a substantially planar rear wall 26 is disclosed, the rear wall 26 can have a multi-faceted face without departing from the scope of the invention. Advantageously, by providing a rear wall 26 that presents a second block face, the block 14 is reversible in a retaining wall or can be used to form an above ground block wall having a rugged, or natural, look on both sides of the above ground block wall.

Figure 2:
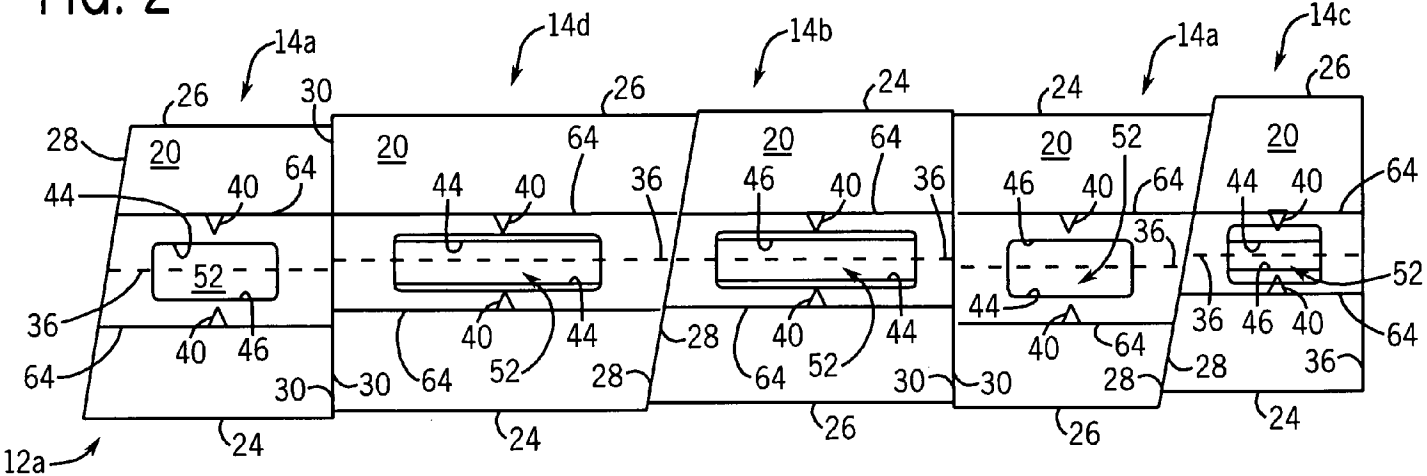
FIG. 2 is a top plan view of a section of the base course of the block wall of FIG. 1.
Figure 5:
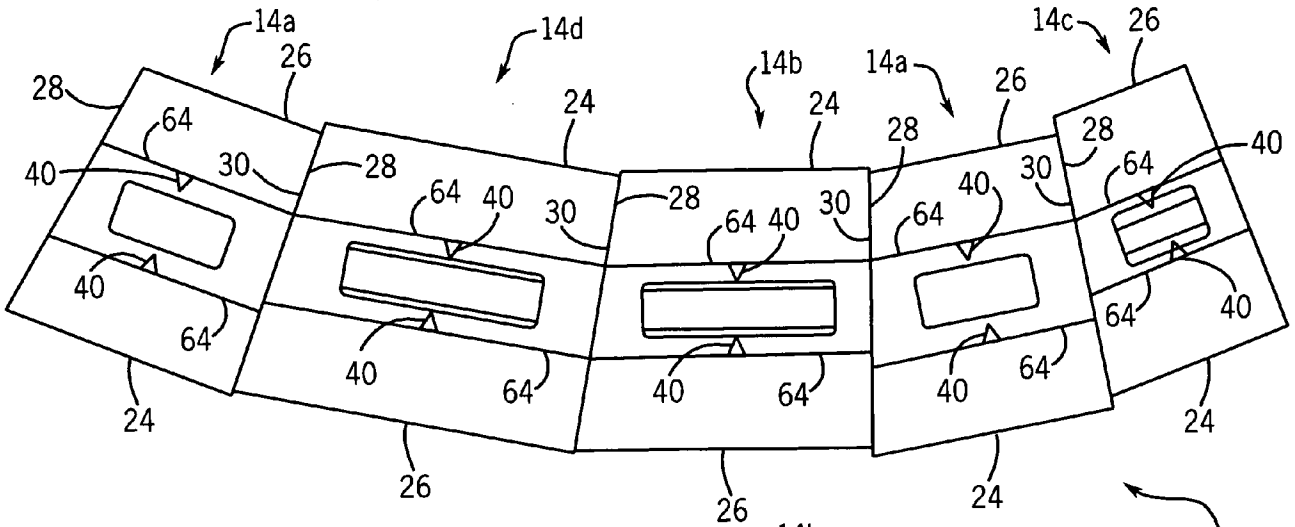
FIG. 5 is a top plan view of the base course of a curved block wall incorporating the present invention.

The side walls 28, 30 extend between the front and rear walls 24, 26 and the upper and lower block surfaces 20, 22. Preferably, side wall 28 is not perpendicular to the front and rear walls 24, 26 (i.e. side wall 28 defines an obtuse angle with one of the front wall 24 and the rear wall 26). As can be seen, the straight block wall 10, shown in FIG. 2, is formed when blocks 14*a*, 14*b*, 14*c*, 14*d* are laid adjacent to each other with complementary angled side walls 28, 30 abutting each other. Advantageously, the angled side wall 28 provides the flexibility of building a curved block wall, such as shown in FIG. 5, when blocks 14*a*, 14*b*, 14*c*, 14*d* are laid with an angled side wall 28 of one block 14 abutting a perpendicular side wall 30, or a non-complementary angled side wall, of an adjacent block 14. Of course, the blocks 14 in a single course can be laid without abutting sidewalls to form gaps between the blocks 14 to provide curved or straight walls, as desired, without departing from the scope of the invention. Moreover, the blocks 14 can be formed with a pair of angled side walls that are complementary in order to form either a straight or curved block wall.

Referring back to FIGS. 2–4, a reference plane 36 spaced from the front and rear walls 24, 26 extends between the pair of side walls 28, 30, and provides a reference from which pin slots 40 and pin engagement surfaces 44, 46 are located in the block 14 in order to properly align the blocks 14 in the block wall 10. Preferably, the reference plane 36 is a central plane defined approximately equidistantly between the front and rear walls 24, 26. However, the reference plane 36 can be any plane perpendicular to the upper and lower block surfaces 20, 22 of the block 14 and extending between the side walls 28, 30.

A pair of pin slots 40 is formed in the upper block surface 20 to position a course of blocks relative to the next lower course at a predetermined batter angle regardless of whether the front wall 24 or rear wall 26 is exposed. Each pin slot 40 is formed in the upper block surface 20 on opposing sides of the central reference plane 36 and spaced equidistantly from the central reference plane 36 which allows either the front wall 24 or rear wall 26 of the block 14 to be exposed while maintaining the proper setback to form the desired batter angle. When building the block wall 10, one of the pin slots 40 receives a pin 48 that engages a pin engagement surface 44, 46 formed in the block 14 forming the next (upper) course of blocks. Preferably, the pin slots 40 are triangular for receiving a triangular pin 48, and are formed in the upper block surface 20 to present a flat outwardly facing engaging surface 50 of the triangular pin 48 against one of the pin engagement surfaces 44, 46 of the block 14 forming the next course of blocks 14 to properly position the front and rear walls 24, 26 of the block 14 relative to the front and rear walls 24, 26 of block 14 forming the prior (lower) course of blocks.

Figure 11:
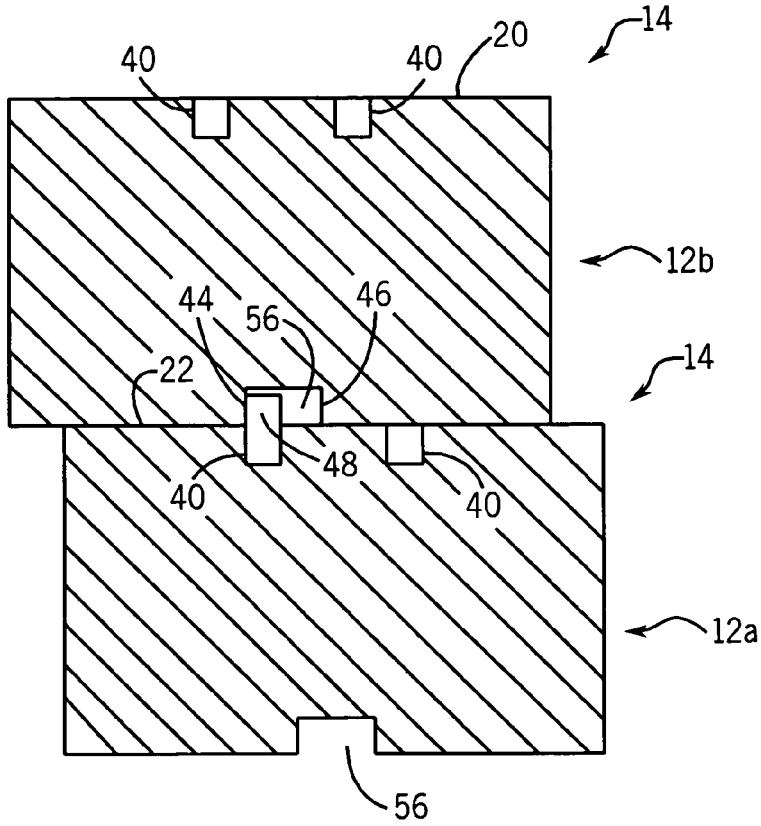
FIG. 11 is a cross sectional view of two courses of a block wall formed from an alternative embodiment of blocks incorporating the present invention.

A core 52 formed through the block 14 between the upper and lower block surfaces 20, 22 includes a top opening 54 and a bottom opening 56. The bottom opening 56 is formed in the lower block surface 22, and includes the forward facing pin engagement surface 44 and the rearward facing pin engagement surface 46. A core 52 formed through the block 14 intersecting the reference plane 36 is preferred because it simplifies assembly of the block wall 10. In particular, the core 52 allows the user to see the pin 48 extending from a block 14 in the prior course through the core 52 when placing the block 14 on the prior course. However, a block 14 can be provided without the core 52, such as shown in FIG. 11, and having an opening or cavity defining the pin engagement surfaces 44, 46 without departing from the scope of the invention.

The forward facing pin engagement surface 44 is proximal the lower block surface 22 and spaced rearwardly (towards the rear face) from the reference plane 36 for engaging the pin 48 received in the pin slot 40 formed in the block 14 forming the lower course of blocks. The rearward facing pin engagement surface 46 is proximal the lower block surface 22 and spaced forwardly(towards the front face) from the reference plane 36 for engaging the pin 48 received in a pin slot 40 formed in the block 14 forming the lower course of blocks.

The pin engagement surfaces 44, 46 are, preferably, equally closer to the reference plane 36 than the pin slots 40 in order to maintain the alignment of blocks 14*a*, 14*b*, 14*c*, 14*d* along the block wall 10 regardless of which face of the block 14 is exposed. The distance A between the pin slot outermost surface 55, and thus the engaging surface 50 of the pin 48, and the pin engagement surface 44, 46 on the same side of the reference plane 36 is equal to the setback of the block 14 from the prior course block 14 from which the pin 48 extends. Preferably, the distance A is not the same in every block 14*a*, 14*b*, 14*c*, 14*d* in order to vary the setback of the blocks 14*a*, 14*b*, 14*c*, 14*d* in a course in order for the block wall 10 to have a natural look.

The pin engagement surfaces 44, 46 extend a sufficient distance between the side walls 28, 30 to allow engagement of at least one pin 48 extending from one of the blocks forming the lower course. For example, as shown in FIG. 11, the bottom opening 56 can be a groove extending across the entire width of the block 14 to form pin engagement surfaces 44, 46 extending the entire width of the block 14, and not form part of a core extending through the block 14, without departing from the scope of the invention.

Figure 3:
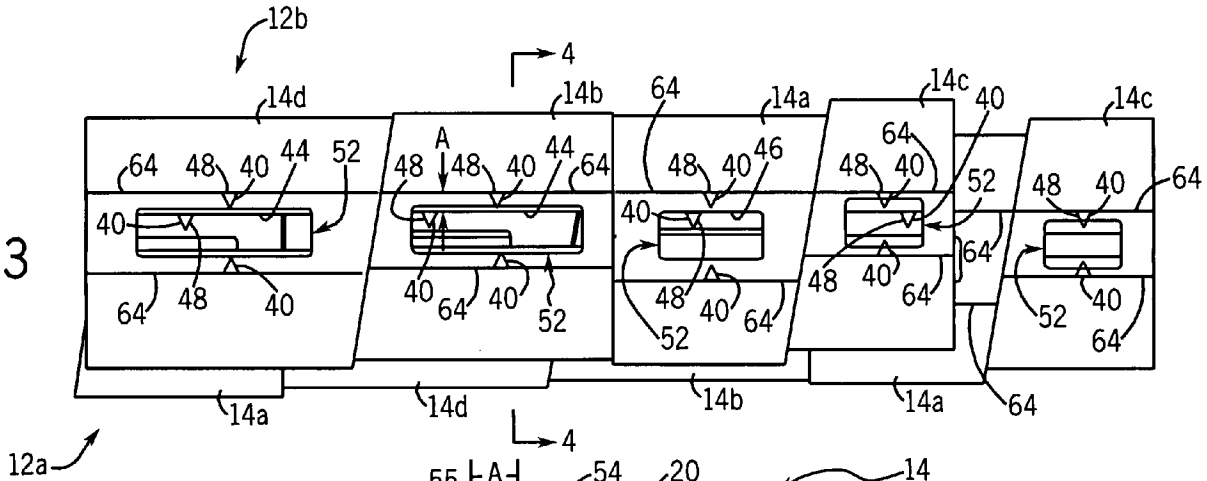
FIG. 3 is a top plan view of a section of the first two courses of the block wall of FIG. 1.
Figure 4:
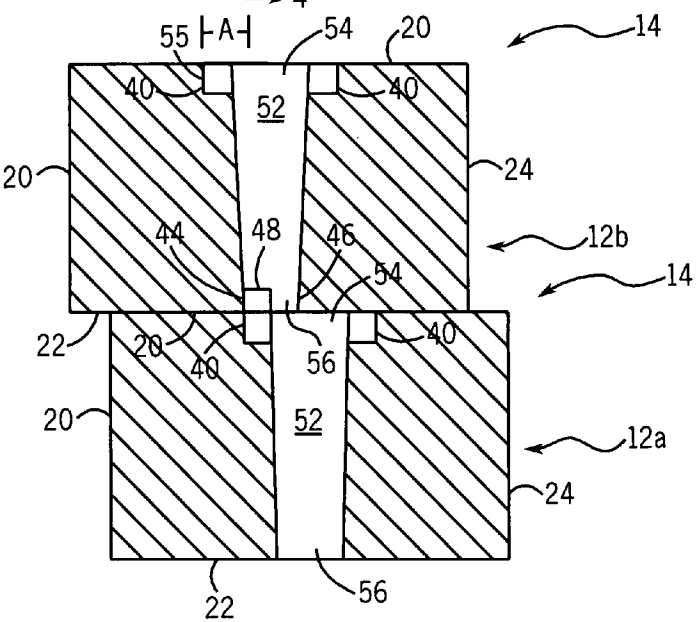
FIG. 4 is a sectional view along line 4—4 of FIG. 3.

As shown in FIGS. 3 and 10, the pin 48 received in the pin slot 40 of the block has a longitudinal axis 57 and, preferably, has a cross section defining an equilateral triangle. Most preferably, the pin 48 has ends 58, 60 which extend along the longitudinal axis 57 from a midsection 62. The midsection 62 is thicker than the ends 58, 60 (i.e. the midsection 62 extends radially from the axis 57 a first distance and the ends 58, 60 extend radially from the axis 57 a second distance, wherein the first distance is greater than the second distance). Advantageously, by providing a pin 48 with a thicker midsection 62 than the ends 58, 60, the pin 48 can be inserted snugly into the pin slots 40 even when the mold forming the pin slots 40 wears to form narrower pin slots 40 than when the mold was new. Although a pin 48 having a cross section defining a triangle is preferred to provide relatively large planar engaging surface 50 for engaging one of the pin engagement surfaces 44, 46, the pins 48 can have any cross sectional shape.

Figure 6:
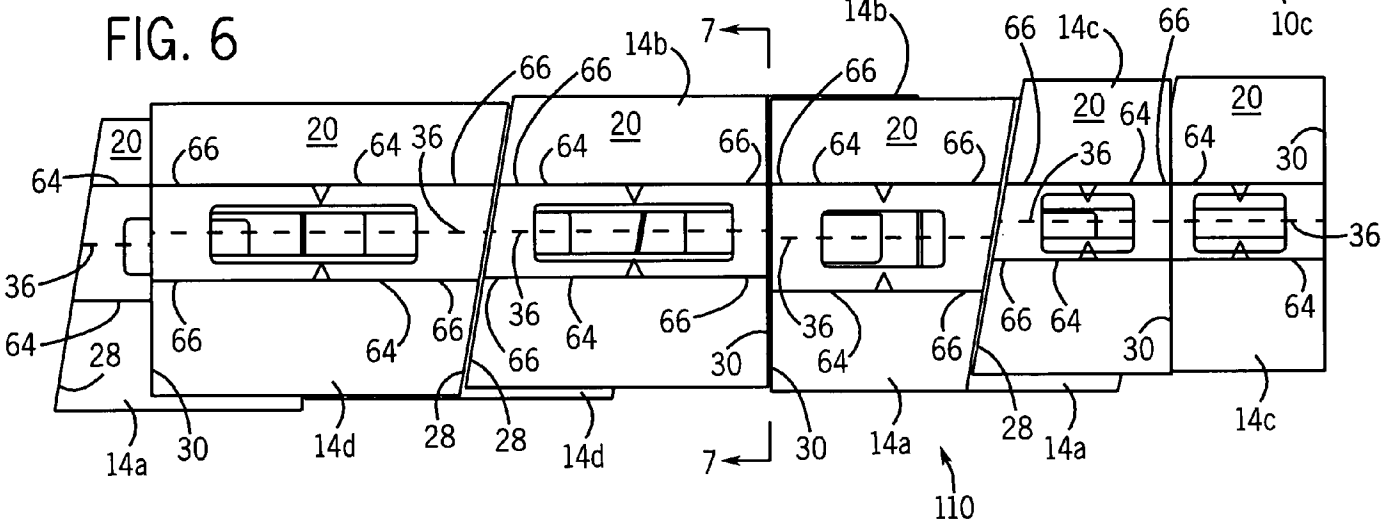
FIG. 6 is a top plan view of a section of the first two courses of the straight above ground block wall incorporating the present invention.

In order to build a decorative above ground wall 110, such as shown in FIGS. 6 and 7, using blocks 14*a*, 14*b*, 14*c*, 14*d* that does not have a batter angle, the pin slot 40 on one side of the reference plane 36 is aligned with one of the pin slots 40 of the blocks 14 in the lower course and adjacent blocks 14. In order to more easily align the pin slots 40, one or more reference lines 64 parallel to the reference plane 36 are formed, such as by molding, in the upper block surface 20 and side walls 28, 30 of the blocks 14. When building the above ground wall 110, at least one of the ends 66 of the reference lines 64 of adjacent blocks 14, including blocks 14 in the lower course, if present, are aligned to properly position the blocks 14 without a setback to form the block wall 110 without a batter angle. Although forming the reference lines 64 in the upper block surface 20 and side walls 28, 30 of each block 14 is preferred, reference lines 64 can be drawn, or etched, on the block using a, sharp object, pencil, chalk, and the like, without departing from the scope of the invention.

Figure 8:
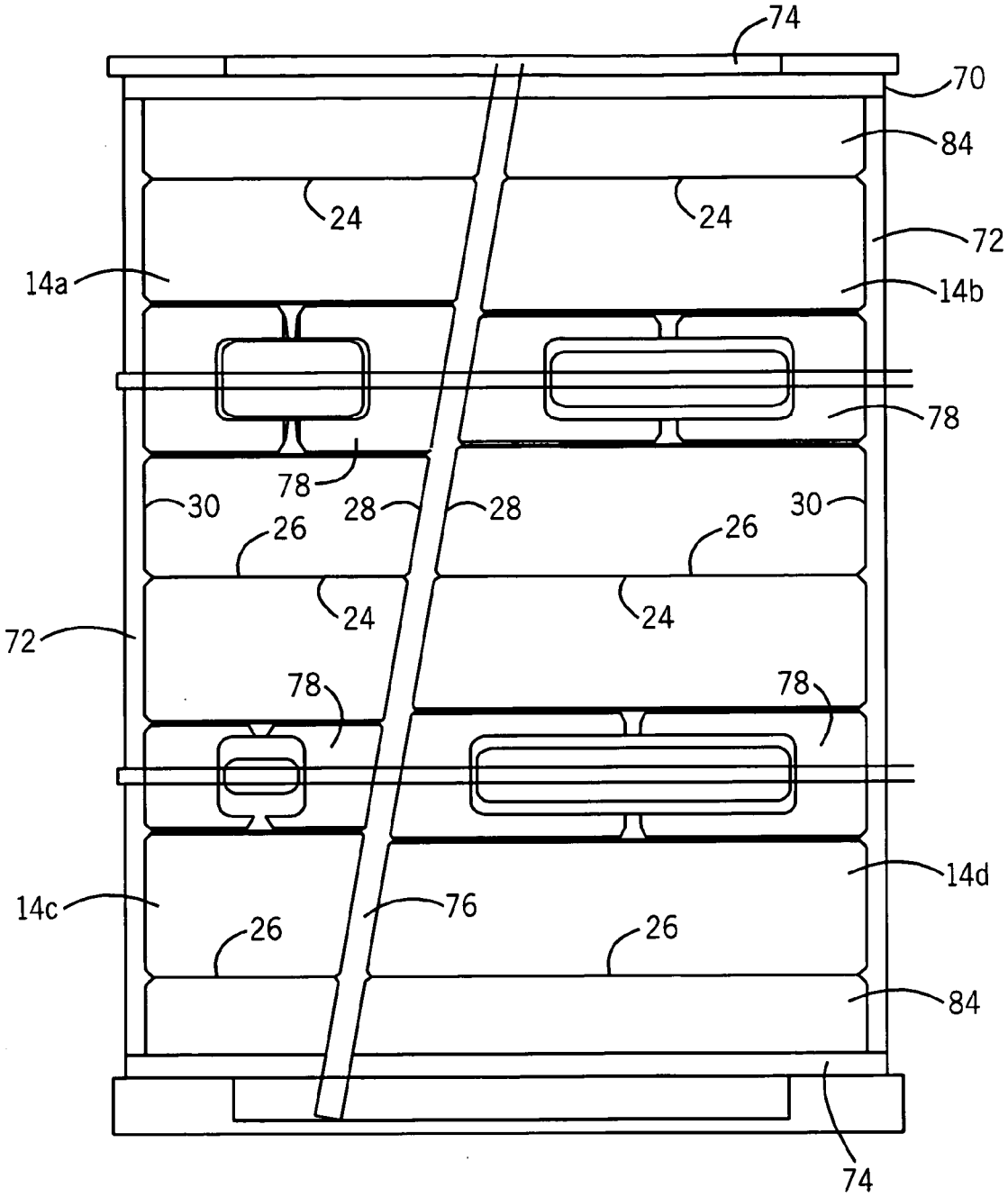
FIG. 8 is a top plan view of a mold for molding blocks incorporating the present invention.

Preferably, the blocks 14*a*, 14*b*, 14*c*. 14*d* are formed in a mold 70, such as shown in FIG. 8, that produces the four blocks 14*a*, 14*b*, 14*c*, 14*d* having different dimensions. The mold 70 is rectangular having two long sides 72 joined by two ends 74. The sides 72 define the perpendicular side wall 30 of each block 14*a*, 14*b*, 14*c*, 14*d*. A diagonal dividing plate 76 extending between the two ends 74 define the angled side walls 28 of each block 14*a*, 14*b*, 14*c*, 14*d*. Although a mold forming four blocks 14*a*, 14*b*, 14*c*, 14*d*, is disclosed, the mold can form one or more blocks 14 without departing from the scope of the invention.

In each block 14*a*, 14*b*, 14*c*, 14*d* formed in the mold 70, a rectangular mold insert 78 having an elongated body 79 with a predetermined draft B forms each block core 52. The draft of the mold insert body 79 determines the distance of the pin engagement surfaces 44, 46 relative to the reference plane 36, and can vary between the blocks 14*a*, 14*b*, 14*c*, 14*d* formed in the mold 70. For example, the insert body 79 forming the core in block 14*a* has a minimum draft necessary to remove the insert 78 from the formed block 14*a*. The inserts 78 used to form blocks 14*b* and 14*d* have bodies 79 with substantially identical drafts which are greater than the minimum draft and less than the draft of the insert body 79 used to form the core 52 in block 14*c*. Triangular structure 80 fixed to the rectangular mold insert 78 forms the pin slots 40 in the upper block surface 20 of the blocks 14 adjacent to the core top opening 54 in each block 14. Rails 84 formed on the bottom of the triangular structures 80 form the reference lines 64 in the block top surfaces 20.

The mold 70 is filled with concrete, or other suitable block material, and allowed to set to form two pairs of joined blocks 81, 82. The joined blocks 81, 82 are removed from the mold 70, and split, using methods known in the art, to form one rugged face on one of the front and rear wall 24, 26 of each block 14*a*, 14*b*, 14*c*, 14*d*. A second rugged face is formed on the other of the front and rear wall 24, 26 of each block 14*a*, 14*b*, 14*c*, 14*d* by splitting excess material 84 off of the front or rear wall 24, 26 of the blocks 14*a*, 14*b*, 14*c*, 14*d* that was formed proximal the mold ends 74. The inserts 78 are then removed, and the blocks 14*a*, 14*b*, 14*c*, 14*d* are available for building a block wall. Of course, the rugged faces, and any other type face, can be formed by molding or other methods known in the art, without departing from the scope of the invention. Moreover, the inserts 78 can be removed prior to splitting, or otherwise separating, the joined blocks 81, 82.

The retaining wall 10 shown in FIGS. 1–4 built from the blocks 14*a*, 14*b*, 14*c*, 14*d* is formed by providing a level space upon which the base course 12*a* of blocks 14*a*, 14*b*, 14*c*, 14*d* are laid. When building the straight retaining wall 10, the blocks 14*a*, 14*b*, 14*c*, 14*d* comprising the base course 12*a* are laid in abutting relation with angled side walls 29 abutting complementary angled side walls 28, perpendicular side walls 30 abutting perpendicular side walls 30, and a reference line 64 of each adjacent block 14*a*, 14*b*, 14*c*, 14*d* aligned. The pins 48 are inserted into the pin slots 40 closest to the hill or earth being retained. The second course 12*b* of blocks 14*a*, 14*b*, 14*c*, 14*d* are then set onto the base course 12*a* in a similar fashion with one of the pin engagement surfaces of each block 14*a*, 14*b*, 14*c*, 14*d* forming the second course 12*b* engaging the engaging surface 50 of at least one of the triangular pins 48. Successive courses can then laid in an identical manner.

The above ground wall 110, shown in FIGS. 6 and 7, can be formed by setting the blocks 14*a*, 14*b*, 14*c*, 14*d* on a level surface or on a top course of a retaining wall, such as described above, by aligning at least one of the reference line ends 66 on each block 14*a*, 14*b*, 14*c*, 14*d* forming the first course 112*a* of the above ground wall 110 with blocks 14*a*, 14*b*, 14*c*, 14*d* with at least one of the reference line ends 66 of the adjacent blocks 14*a*, 14*b*, 14*c*, 14*d* in the first course 112*a* of the above ground wall 110. If the first course 112*a* of the above ground wall 110 is set on top of a top course of a retaining block wall, the reference line ends 66 of the blocks 14*a*, 14*b*, 14*c*, 14*d* forming the first course 112*a* of the above ground wall 110 are aligned with the reference line ends 66 formed in the blocks 14*a*. 14*b*, 14*c*, 14*d* forming the top course of the retaining wall.

Successive courses, such as course 112*b*, are set on the prior course of blocks with the block 14*a*, 14*b*, 14*c*, 14*d* forming the second course 112*b* by aligning the reference line ends 66 on one side of the reference plane 36 of the adjacent blocks 14*a*, 14*b*, 14*c*, 14*d* in the second course 112*b* with the each other and with the reference line ends 66 on one side of the reference plane 36 formed in the blocks 14*a*. 14*b*, 14*c*, 14*d* forming the first course 112*a*. Of course, cap blocks can be provided to finish off the exposed top course of a retaining or above ground wall. Moreover, grout or adhesive can be used to bond the blocks together and enhance the structural integrity of the block wall.

The present invention provides blocks 14*a*, 14*b*, 14*c*, 14*d* for building both retaining and above ground walls 10, 110. Advantageously, the blocks includes pairs of pin slots 40 for receiving a pin 48 that engages one of a pair of pin engagement surfaces 44, 46 of a block 14*a*, 14*b*, 14*c*, 14*d* forming the next course of the block wall 10, 110 and form a retaining wall 10 with a predetermined batter angle when either the face of the front or rear wall 24, 26 is exposed. Moreover, depending upon which face is exposed, the block wall 10, 110 can be formed in a straight line or curved. In addition, by aligning pin slots, or reference line ends 66 of reference lines 64 parallel to the reference plane 36, an above ground block wall can be built without a batter angle using the same blocks 14*a*, 14*b*, 14*c*, 14*d*.

Figure 12:
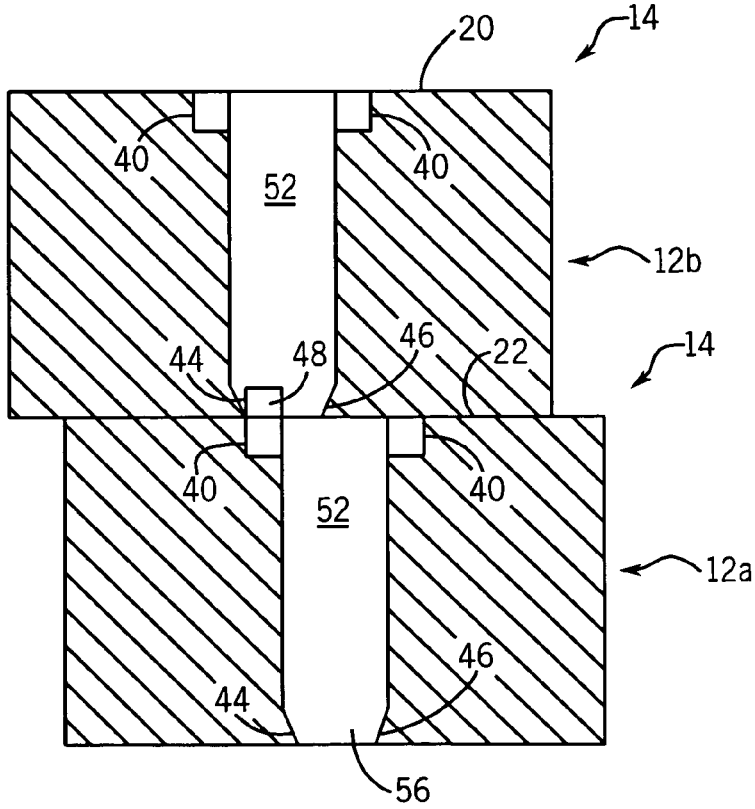
FIG. 12 is a cross sectional view of two courses of a block wall formed from an alternative embodiment of blocks incorporating the present invention.

While there has been shown and described what are at present considered the preferred embodiment of the invention, it will be obvious to those skilled in the art that various changes and modifications can be made therein without departing from the scope of the invention defined by the appended claims. Therefore, various alternatives and embodiments are contemplated as being within the scope of the following claims particularly pointing out and distinctly claiming the subject matter regarded as the invention. For example, a block 14, such as shown in FIG. 12, can be provided having a relatively straight core 52 and pin engagement surfaces 44, 46 that extend inwardly toward the core center proximal the lower block surface 22 of the block 14. In addition, more than one pair of pin slots can be formed in the upper block surface 20 of the block 14 on opposing sides of the central reference plane 36 and spaced equidistantly from the central reference plane 36 to provide the user with a choice of setback distances for the block 14 to define a batter angle different from the batter angle defined by the first pair of pin slots 40.

I claim:

1. A block suitable for forming a block wall, said block comprising:

a front wall extending between upper and lower block surfaces and presenting a first block face;

a rear wall spaced from said front wall and extending between the upper and lower block surfaces and presenting a second block face facing away from said first block face;

a pair of side walls extending between said front and rear walls and said upper and lower block surfaces, wherein a reference plane substantially parallel to said front and rear walls extends between said pair of side walls;

at least one pair of pin slots formed in said upper block surface, each pin slot of said at least one pair of pin slots being formed in said upper block surface on opposing sides of said reference plane and spaced from said reference plane, wherein at least one of said pin slots having a planar side substantially parallel with said reference plane for orientating a planar outwardly facing surface of a pin received in said at least one pin slot to engage said planar outwardly facing surface of the pin with an inner wall of a block placed on said upper block surface; and an opening formed in said lower block surface, said opening having a forward facing inner wall intersecting said lower block surface and spaced rearwardly from said reference line and a rearward facing inner wall intersecting said lower block surface and spaced forwardly from said reference plane, wherein said forward facing inner wall and said rearward facing inner wall are closer to said reference plane than said pin slots.

2. The block as in claim 1, in which said opening is one end of a core formed through said block between said upper and lower block surfaces.

3. The block as in claim 2, in which said core opens onto said upper block surface between said pair of pin slots.

4. The block as in claim 2, in which said forward facing inner wall and said rearward facing inner wall are equidistant from said reference plane.

5. The block as in claim 1, in which each pin slot of said at least one pair of pin slots is approximately equidistant from said reference plane.

6. The block as in claim 1, in which said reference plane is approximately equidistant from said front and rear walls.

7. The block as in claim 1, in which a reference line parallel to said reference plane is formed in said upper block surface.

8. The block as in claim 1, in which reference lines parallel to said reference plane are formed in said side walls.

9. The block as in claim 1, in which at least one of said pin slots is triangular.

10. The block as in claim 1, including a pin received in at least one of said pin slots.

11. The block as in claim 10, in which said pin has opposing ends extending from a center portion along a longitudinal axis, wherein said center portion extends radially from said axis a first distance and at least one of said ends extend radially from said axis a second distance, wherein said first distance is greater than said second distance.

12. The block as in claim 1, in which said pair of pin slots are spaced equidistantly from said reference plane.

13. The block as in claim 1, in which said forward facing inner walls and said rearward facing inner wall are equally closer to said reference plane than said pin slots.

14. The block as in claim 1, in which at least one of said side walls defines an obtuse angle with one of said front wall and said rear wall.

15. A block wall having at least two courses of blocks, one of said courses being supported by the other of said courses, said block wall comprising:

at least one first block forming part of one of said courses, said at least one block including a front wall extending between upper and lower block surfaces and presenting a first block face, a rear wall spaced from said front wall and extending between the upper and lower block surfaces and presenting a second block face facing away from said first block face, a pair of side walls extending between said front and rear walls and said upper and lower block surfaces, wherein a first reference plane spaced from said front and rear walls extends between said pair of side walls, at least one pair of pin slots formed in said upper block surface, each pin slot of said at least one pair of pin slots being formed in said upper block surface on opposing sides of said first reference plane and spaced from said first reference plane; and at least one second block supported by said at least one first block and forming part of the other of said courses, said at least one second block including a front wall extending between upper and lower block surfaces and presenting a first block face, a rear wall spaced from said front wall and extending between the upper and lower block surfaces and presenting a second block face facing away from said first block face, a pair of side walls extending between said front and rear walls and said upper and lower block surfaces, wherein a second reference plane spaced from said front and rear walls extends between said pair of side walls, an opening formed in said lower block surface, said opening having a forward facing inner wall intersecting said lower block surface and spaced rearwardly from said second reference plane and a rearward facing inner wall intersecting said lower block surface and spaced forwardly from said second reference plane, in which a pin received in one of said pin slots of said pair of pin slots engages one of said inner walls to space one of said front and rear walls of said at least one first block relative to one of said front and rear walls of said second block and form a retaining wall having a batter angle.

16. The block wall as in claim 15, in which said at least one first block includes at least one reference line parallel to said first reference plane spaced from said front and rear walls of said first block, and said at least one first block includes at least one reference line parallel to said second reference plane spaced from said front and rear walls of said second block, wherein ends of each of said reference lines are aligned to form an above ground wall.

17. The block wall as in claim 15, in which said opening of said at least one second block is one end of a core formed through said at least one second block between said upper and lower block surfaces.

18. The block wall as in claim 17, in which said core opens onto said upper block surface of said at least one second block between at least one pair of pin slots formed in said upper block surface of said at least one second block.

19. The block wall as in claim 15, in which said forward facing wall and said rearward facing wall of said at least one second block are equidistant from said reference plane of said at least one second block.

20. The block wall as in claim 18, in which said pin slots of said at least one pair of pin slots are spaced equidistantly from said reference plane of said at least one first block.

21. The block wall as in claim 15, in which said pin slots are approximately equidistant from said reference plane of said at least one first block.

22. The block wall as in claim 15, in which said reference plane of said at least one second block is approximately equidistant from said front and rear walls of said at least one second block.

23. The block wall as in claim 15, in which at least one of said pin slots is triangular, and said pin has a triangular cross section which snugly fits in said triangular pin slot.

24. The block wall as in claim 15, in which said pin has opposing ends extending from a center portion along a longitudinal axis, wherein said center portion extends radially from said axis a first distance and at least one of said ends extend radially from said axis a second distance, wherein said first distance is greater than said second distance.

25. The block wall as in claim 15, in which said inner walls at said lower block surface of said at least one second block are equally closer to said reference plane of said at least one second block than said pin slots formed in said upper surface of said at least one second block.

26. The block wall as in claim 15, in which at least one of said side walls of each of said at least one first and second blocks defines an obtuse angle with one of said front wall and said rear wall of each of said at least one first and second blocks.

27. A block suitable for forming a block wall, said block comprising:

a front wall extending between upper and lower block surfaces and presenting a first block face;

a rear wall spaced from said front wall and extending between the upper and lower block surfaces and presenting a second block face facing away from said first block face;

a pair of side walls extending between said front and rear walls and said upper and lower block surfaces, wherein a reference plane substantially parallel to said front and rear walls extends between said pair of side walls;

at least one pair of pin slots formed in said upper block surface, each pin slot of said at least one pair of pin slots being formed in said upper block surface on opposing sides of said reference plane and equidistantly spaced from said reference plane, wherein at least one of said pin slots having a planar side substantially parallel with said reference plane for orientating a planar outwardly facing surface of a pin received in said at least one pin slot to engage said planar outwardly facing surface of the pin with an inner wall of a block placed on said upper block surface; and an opening formed in said lower block surface, said opening having a forward facing inner wall intersecting said lower block surface and spaced rearwardly from said reference line and a rearward facing inner wall intersecting said lower block surface and spaced forwardly from said reference plane, wherein said inner walls at said lower block surface are equidistantly spaced from and closer to said reference plane than said pin slots.

28. The block as in claim 27, in which said opening is one end of a core formed through said block between said upper and lower block surfaces.

29. The block as in claim 27, in which said core opens onto said upper block surface between said pair of pin slots.

30. The block as in claim 27, in which said reference plane is approximately equidistant from said front and rear walls.

31. The block as in claim 27, in which a reference line parallel to said reference plane is formed in said upper block surface.

32. The block as in claim 27, in which reference lines parallel to said reference plane are formed in said side walls.

33. The block as in claim 27, in which at least one of said pin slots is triangular.

34. The block as in claim 27, including a pin received in at least one of said pin slots.

35. The block as in claim 34, in which said pin has opposing ends extending from a center portion along a longitudinal axis, wherein said center portion extends radially from said axis a first distance and at least one of said ends extend radially from said axis a second distance, wherein said first distance is greater than said second distance.

36. The block as in claim 27, in which at least one of said side walls defines an obtuse angle with one of said front wall and said rear wall.

* * * * *

UNITED STATES PATENT AND TRADEMARK OFFICE

CERTIFICATE OF CORRECTION

PATENT NO. : 7,096,634 B2
APPLICATION NO. : 10/693062
DATED : August 29, 2006
INVENTOR(S) : Dean, Jr.

It is certified that error appears in the above-identified patent and that said Letters Patent is hereby corrected as shown below:

Column 8, Claim 13, Line 44 “walls” is changed to -- wall --

Signed and Sealed this

Sixteenth Day of January, 2007

JON W. DUDAS
*Director of the United States Patent and Trademark Office*